US005992113A

United States Patent [19]

Carter, Sr. et al.

[11] Patent Number: 5,992,113

[45] Date of Patent: Nov. 30, 1999

[54] COMPRESSIBLE FOAM WEATHER STRIPPING

[75] Inventors: Robert G. Carter, Sr., Elmhurst; John Szynal, Burr Ridge, both of Ill.

[73] Assignee: John B. Szynal, Burr Ridge, Ill.

[21] Appl. No.: 08/781,505

[22] Filed: Jan. 8, 1997

Related U.S. Application Data

[63] Continuation of application No. 08/536,667, Sep. 29, 1995.

[51] Int. Cl.[6] ..... E04C 5/07

[52] U.S. Cl. ..... 52/396.06; 52/204.1; 52/213; 52/309.4

[58] Field of Search ..... 52/204.1, 204.5, 52/208, 396.03, 396.06, 396.07, 402, 213, 393, 309.4

[56] References Cited

U.S. PATENT DOCUMENTS

| | | | |
|---|---|---|---|
| 2,156,681 | 5/1939 | Dewhirst et al. . | |
| 2,230,688 | 2/1941 | Irwin . | |
| 3,604,169 | 9/1971 | Smith . | |
| 3,923,411 | 12/1975 | Berghman . | |
| 3,967,911 | 7/1976 | Miers | 52/396.03 X |
| 4,204,373 | 5/1980 | Davidson . | |
| 4,362,427 | 12/1982 | Mass et al. . | |
| 4,478,020 | 10/1984 | Jackson | 52/396.06 X |
| 4,979,846 | 12/1990 | Hill et al. | 52/396.03 X |

FOREIGN PATENT DOCUMENTS

| | | | |
|---|---|---|---|
| 360682 | 3/1990 | European Pat. Off. | 52/396.03 |
| 1242975 | 8/1960 | France | 52/396.06 |

*Primary Examiner*—Carl D. Friedman
*Assistant Examiner*—Timothy B. Kang

[57] ABSTRACT

A resilient deformable sealing strip for sealing a gap between a window jamb and a rough opening of a window includes a generally V-shaped body portion formed of resilient material having two wing portions having proximal and distal ends, said proximal ends meeting at a common vertex and diverging from each other at a predetermined angle. The body portion has a planar axis defined between the vertex and extending away from the vertex toward a midpoint between the distal ends of the wing portions, where the planar axis bisects the predetermined angle. The wing portions are configured to compressibly deform toward each other in a direction orthogonal to the planar axis to permit the body portion to compress and sealingly fill the gap between the window jamb and the rough opening of the window. Each wing portion has at least one of a linear channel and a linear rib disposed on an outside surface of the wing portion and extending along a length of the body portion. The at least one linear channel and linear rib are configured to deform in response to deformation of the wing portions to grippingly and sealingly engage a surface of the window jamb or a surface of the rough opening, respectively, forming a sealingly resilient barrier therebetween.

18 Claims, 4 Drawing Sheets

COMPRESSIBLE FOAM WEATHER STRIPPING

This is a continuation of copending application Ser. No. 08/536,667, filed on Sep. 29, 1995 and currently pending.

BACKGROUND OF THE INVENTION

The present invention relates generally to weather stripping and more specifically to a deformable weather stripping especially useful in sealing and thermally insulating the space or gap between a window jamb and a rough opening of a window.

Modern construction techniques in both commercial and residential buildings typically rely on the use of prefabricated windows. Such prefabricated windows are installed in a "rough" opening in the wall which is dimensionally similar to the dimensions of the prefabricated window. A slight gap of up to one inch between the window edges or jambs and the rough opening is typically allowed to account for variations in measurement error and workmanship. Shims, typically made of scrap wood, are usually inserted to fill the gaps and to provide structural support.

Various forms of thermal insulating material, such as fiberglass, solid or liquid foam, paper products and the like are "stuffed" or "blown" into the gap area to fill the void. Caulking material is then applied around the gap to form a weather-tight seal and decorative trim is applied to hide the caulking.

Known methods for sealing the gap between the window jamb and the rough opening, such as insertion of fiberglass insulation into the gap, are time consuming and imprecise. Such a method may require between twenty to thirty minutes to insert the fiberglass and apply the caulking or bonding material. A worker must use a tool, such as a screwdriver or a spatula, to essentially fold the fiberglass material along an imaginary centerline and "stuff" it into the gap. Since the fiberglass is generally bent in half, the half sections tend to shift and twist when inserted using the tool such that uneven portions of insulation are wedged into the gap. Insertion in such a manner causes the material to twist and deform asymmetrically leading to nonuniform distribution of insulation within the gap.

If the gaps are particularly wide, it becomes difficult to hold the fiberglass in place within the gap while adding additional fiberglass. This increases installation time and cost. Since is it difficult to apply the fiberglass uniformly within the gap, the thermal insulation value along the gap varies.

Furthermore, all buildings shift and settle in time causing movement along beams and within wall structures. This often causes the gap between the window jamb and the rough opening to shift or slightly change shape. Fiberglass insulation, which has been stuffed into the gap, does not conform to such dimensional changes in the size of the gap causing the insulation to essentially pull away from either the window jamb or the border of the rough opening. This results in a reduced thermal insulation value and higher energy costs.

The caulking or bonding material applied to the gap to fully seal the gap is even more intolerant of building settling. Small dimensional changes in the size of the gap cause the caulking to crack and split, thus possibly allowing air flow through the gap, again reducing insulation value. Cracked caulking may also allow water vapor to pass through the gap, thus causing condensation problems.

In addition to building settling, wood structures tend to swell and shrink depending on climatic conditions, seasonal changes and the progression of time. Such changes compound the problems associated with the use of fiberglass insulation and caulking.

Furthermore, use of fiberglass insulation may give rise to environmental concerns. Workers using fiberglass products typically must, at least, wear a face mask. Contact between fiberglass insulation products and the skin is also ill-advised as it may be extremely irritating and may cause skin rashes. Use of liquid foam insulation also raises environmental concerns as the liquid vapors are toxic and must be avoided.

Known hard rubber and foam products have been used to seal joints between roadway sections, pavement and expansion joints. However, such hard rubber products are not well-suited for thermally insulating and sealing the gap between the window jamb and the rough opening of the window since they can not adequately deform to the dimensional changes associated with window installation. Further, such hard rubber products cannot be compressed without causing damage or deformation of the wooden or thin metal window structures.

Accordingly, it is a object of the present invention to substantially overcome the above-described problems.

It is another object of the present invention to provide a compressible foam weather stripping that deforms and compresses to fill a gap between a window jamb and a rough window opening.

It is a further object of the present invention to provide a compressible foam weather stripping that uniformly thermally insulates a gap between a window jamb and a rough window opening and eliminates the need for caulking compound.

It is also an object of the present invention to provide a compressible foam weather stripping that accommodates changes in gap size due to building settling and material swelling and shrinking.

It is still another object of the present invention to provide a compressible foam weather stripping that is easy and quick to install using a simple tool.

It is yet another object of the present invention to provide a compressible foam weather stripping that can be used in a wide variety of gap sizes and in non-uniform gaps.

SUMMARY OF THE INVENTION

The disadvantages of weather stripping are substantially overcome with the present invention by providing an improved compressible foam weather stripping which is easy to install and sealingly insulates a gap between a window jamb and a rough window opening.

The present invention allows custom built windows and prefabricated windows to be easily and quickly installed and finished. The compressible weather stripping is easily installed using standard tools, such as a spatula or putty knife, by simply applying the tool to an interior V-shaped portion of the stripping and applying moderate force to wedge the vertex of the stripping into the gap between the window jamb and a rough window opening. A conventional window may be finished using the present invention in as little as five minutes, whereas finishing such a window using known techniques and materials requires about between twenty to thirty minutes.

Since the novel weather stripping deforms and compresses to fill the gap, a wide variation in gap size may be accommodated. Additionally, since the stripping remains resilient, changes in gap size over time do not present difficulties. Even if the gap size changes by as much as 50%, the inventive weather stripping will expand or compress to accommodate the change while maintaining sealing and thermal insulating qualities.

Since the weather stripping can compress and expand to a great degree, variations in gap size along a single boundary existing at the time of installation do not require special attention. The stripping is simply inserted into the gap and it deforms to fill the gap, regardless of the variation in gap size.

Use of the inventive weather stripping is cost effective as it is quick and easy to install and provides a high degree of thermal insulation. Additionally, caulking, which is prone to cracking, is not needed to seal the gap. This saves time and expense.

Special linear ribs and linear channels disposed along the body of the weather stripping provide gripping edges that permit the edges of the stripping to maintain sealing contact with the window jamb and the rough window opening even if the window jamb shifts position with respect to the rough window opening.

More specifically, a resilient deformable sealing strip for sealing a gap between a window jamb and a rough opening of a window according to the present invention includes a generally V-shaped body portion formed of resilient material having two wing portions with proximal and distal ends, the proximal ends meeting at a common vertex and diverging from each other at a predetermined angle.

The body portion has a planar axis defined between the vertex and extending away from the vertex toward a midpoint between the distal ends of the wing portions, where the planar axis bisects the predetermined angle. The wing portions are configured to compressibly deform toward each other in a direction orthogonal to the planar axis to permit the body portion to compress and sealingly fill the space between the window jamb and the rough opening of the window.

Each wing portion has a linear channel and a linear rib or a combination thereof disposed on an outside surface of the wing portion and extending along a length of the body portion. The linear channels and linear ribs are configured to deform in response to deformation of the wing portions to grippingly and sealingly engage a surface of the window jamb or a surface of the rough opening, respectively, forming a sealingly resilient barrier therebetween.

BRIEF DESCRIPTION OF THE DRAWINGS

The features of the present invention which are believed to be novel are set forth with particularity in the appended claims. The invention, together with further objects and advantages thereof, may best be understood by reference to the following description in conjunction with the accompanying drawings.

DETAILED DESCRIPTION OF THE INVENTION

Figure 1:
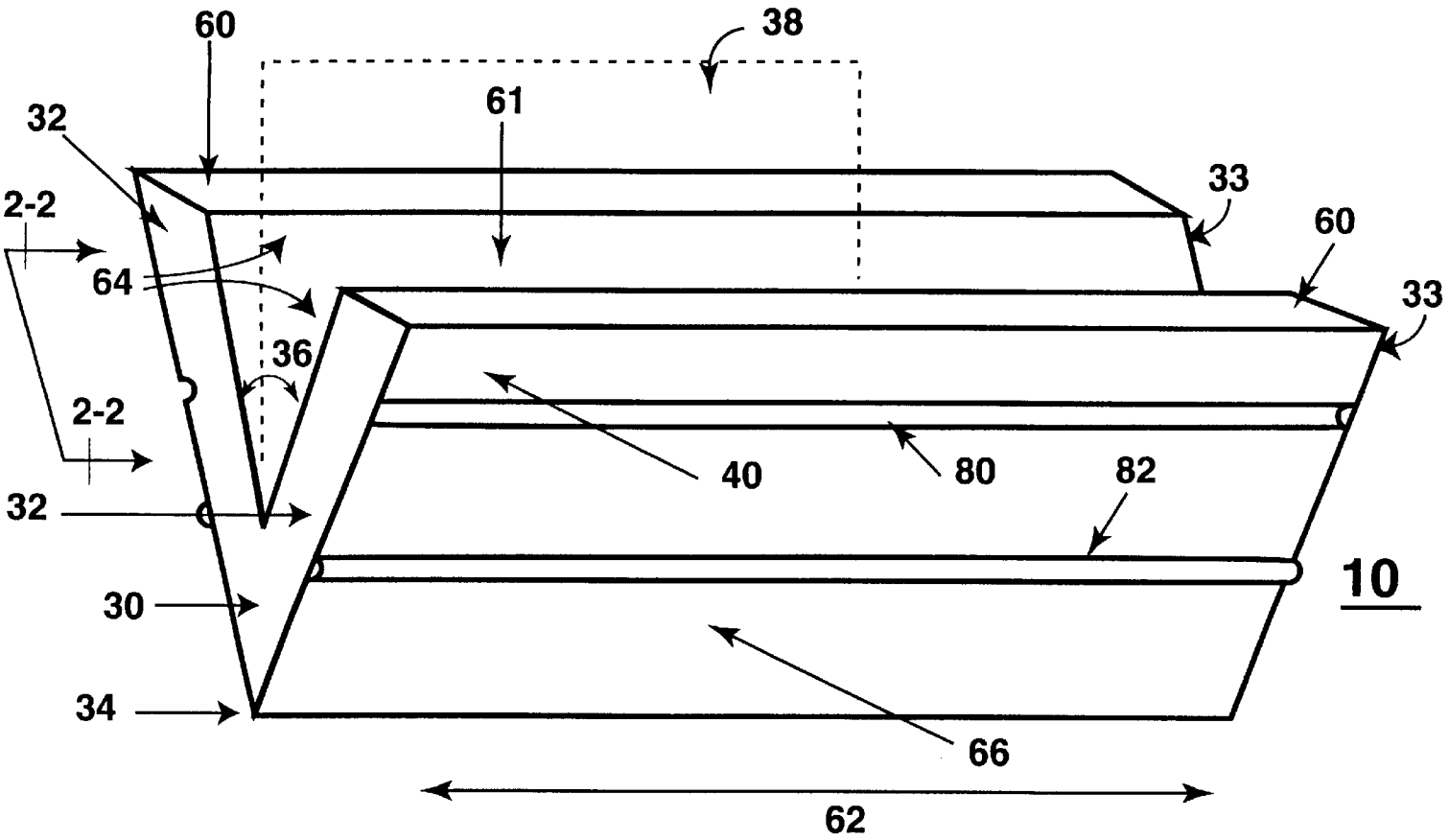
FIG. 1 is a perspective view of a specific embodiment of a compressible foam weather stripping according to the present invention.
Figure 2:
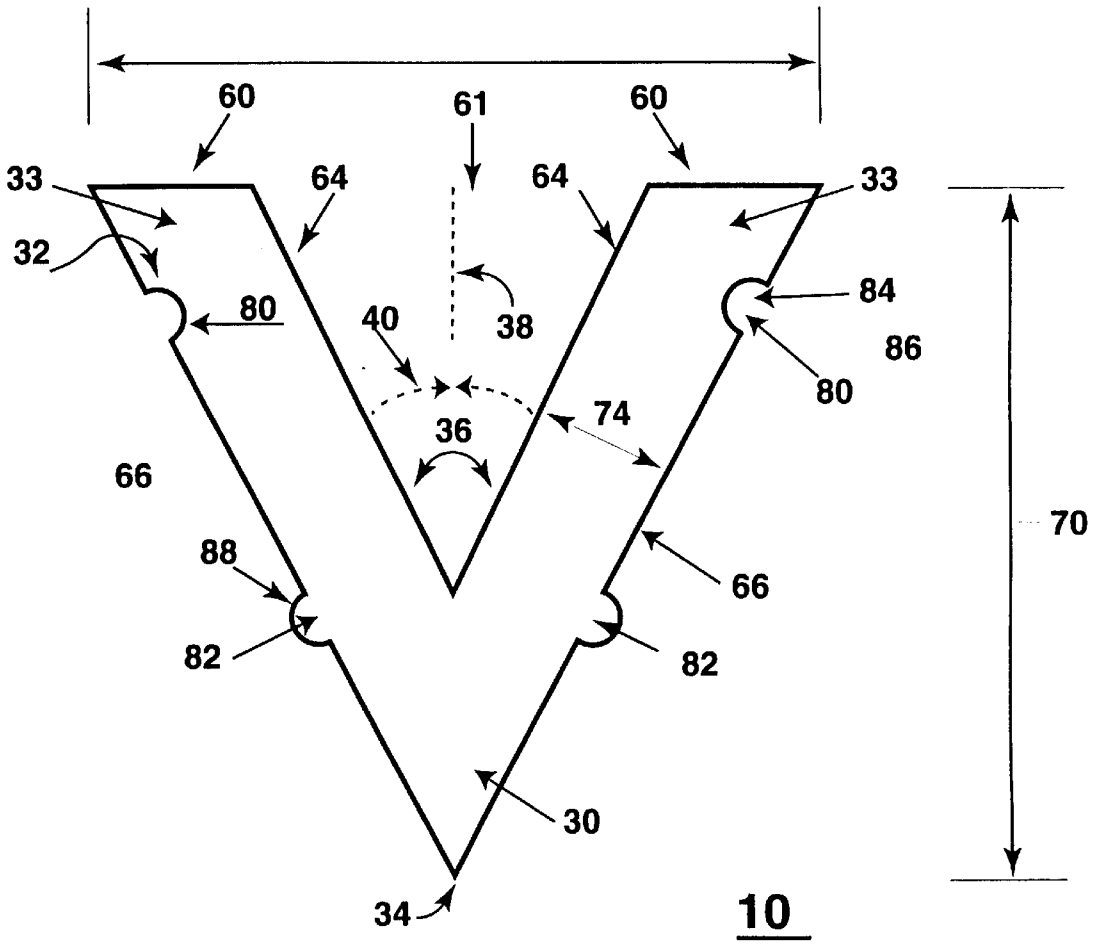
FIG. 2 is a head-on cross-sectional view of a specific embodiment of a compressible foam weather stripping according to the present invention taken along line 2—2 of FIG. 1 and in the direction generally shown.
Figure 3:
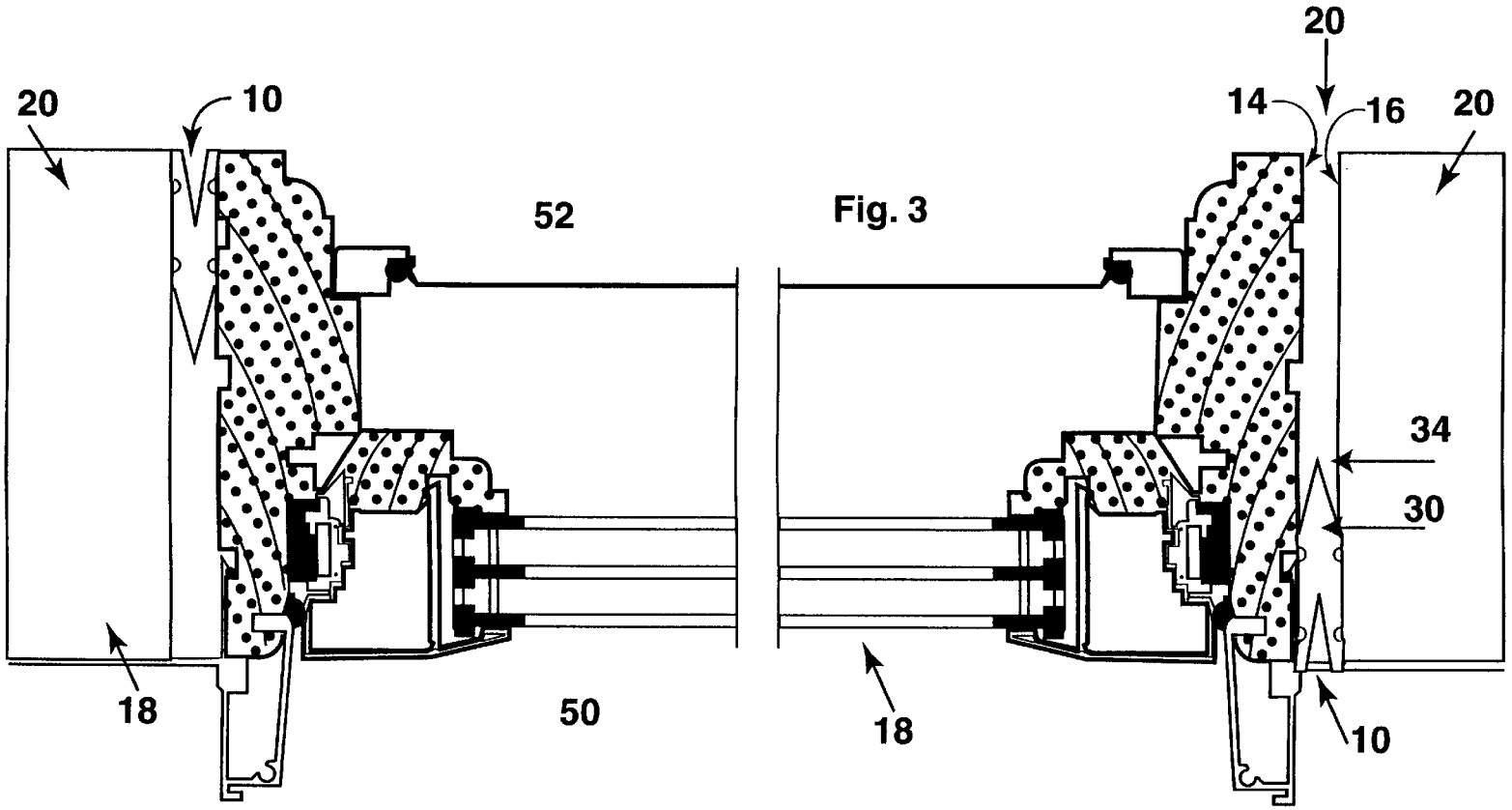
FIG. 3 is a top sectional view of a specific embodiment of a conventional window construction showing the compressible foam weather stripping applied in a vertical position.

Referring now to FIGS. 1–3, a compressible foam weather stripping 10 is shown generally in FIGS. 1-2 and is shown in an operative construction in FIG. 3 where identical reference numerals are used to identify like structures. The compressible foam weather stripping 10 is a resilient and deformable sealing strip for sealing a space or gap 12 between a surface of a window jamb 14 and a surface of a rough opening 16 of a window 18. The phrase "surface of a rough opening" will be used interchangeably with the phrase "rough opening" hereinafter. For example, the window 18 may be a multi-panel prefabricated window or a custom-built window installed within the rough opening 16. The rough opening 16 is the cut-out portion within a wall structure 20, as is known in the art.

The weather stripping 10 has a generally V-shaped or wedge-shaped body portion 30 formed from resilient material, such as from compressible polyurethane foam, as is known in the art. Such polyurethane foam has desirable thermal insulating qualities, however, any suitable resilient foam product may be used. The weather stripping 10 is a unitary structure having no hollow compartments or internal stiffeners. Rather, the cross-section is solid and particularly lends itself to production using relatively simple extrusion methods, as compared to hollow or compartmentalized structures.

The body portion 30 has two wing portions 32, proximal ends 33 of which meet at a common vertex 34 and diverge from each other at a predetermined angle, shown by reference numeral 36 of FIG. 2. For purposes of illustration only, the body portion 30 is shown in FIGS. 1 and 2 as having an imaginary planar axis 38 defined between the vertex 34 and extending away from the vertex toward a midpoint between distal ends 33 of the wing portions 32. The planar axis 38 divides the angle 36 in half. The angle 36 between wing portions 32 is preferably about between fifty-five and sixty-five degrees when the body portion 30 is in an un-compressed and un-deformed state. However, the angle 36 may range from about between thirty degrees to eighty-five degrees.

The wing portions 32 are configured to be compressible and to deform under pressure toward each other in a direction orthogonal to the planar axis 38, as shown generally by arrows 40 in FIGS. 1 and 2. This permits the body portion 30 and wing portions 32 to compress and sealingly fill the space or gap 12 between the window jamb 14 and the rough opening 16. When the weather stripping 10 is secured within the gap 12, air, water vapor and particulate matter present at an exterior 50 portion of the window 18 are prevented from entering the window structure. This also insures proper thermal insulation between the exterior 50 portion of window 18 and an interior portion 52 of the window. The wing portions 32 terminate outwardly in substantially flat peripheral edges 60 disposed perpendicular to the planar axis 38 and extending along an entire length 62 of the body portion 30. The weather stripping 10 may be manufactured in any suitable length, for example, fifty foot lengths, and may be coiled upon itself to form a convenient roll. The weather stripping 10 may be cut to suitable lengths for installation.

Each wing portion 32 includes an inside sidewall 64 and an outside sidewall 66 extending along the entire length 62 of the body portion where the inside and outside sidewalls are substantially parallel to each other. Each wing portion 32 is preferably equal in height as measured from the vertex 34 to the flat peripheral edges 60. However, the wing portions 32 may be of differing heights depending upon the application.

The wing portions 32 are configured to deform to such a degree such that the wing portions meet each other along inside sidewalls 64 coplanar with the planar axis 38, essentially "closing" a V-shaped gap 61 between the wing portions and reducing the predetermined angle 36 to zero degrees. Thus, under sufficient deforming pressure, the body portion 30 and the wing portions 32 compress and appear as a substantially closed solid structure, as more clearly shown in FIG. 3.

The weather stripping 10 may be produced in any suitable dimensions and may be conveniently produced in a plurality of common sizes, such as small, medium and large sizes, depending upon the application and dimensions of the window and surrounding framework. In the illustrated embodiments shown in FIGS. 1–3, typical, but by no means limiting representative dimension are as follows: For a small size of weather stripping 10, the overall height 70 measured between the vertex 34 and the flat peripheral edges 60 is about 1.0 inch, the maximum width 70 measured between the distal ends 33 of the wing portions 32 is about 1.0 inch and a maximum thickness 74 of each wing portion is about 0.25 inches.

For a medium size weather stripping 10, the overall height 70 measured between the vertex 34 and the flat peripheral edges 60 is about 3.0 inches, the maximum width 70 measured between the distal ends 33 of the wing portions 32 is about 3.0 inches and the maximum thickness 74 of each wing portion is about 0.50 inches.

For a large size, the overall height 70 measured between the vertex 34 and the flat peripheral edges 60 is about 8.0 inches, the maximum width 70 measured between the distal ends 33 of the wing portions 32 is about 5.0 inches and the maximum thickness 74 of each wing portion is about 1.50 inches.

The outside sidewall 66 of each wing portion 32 has at least one linear channel 80 or a linear rib 82 or a combination of linear channels and linear ribs. Alternatively, the wing portions 32 may have no channels or ribs. Preferably, one linear channel 80 and one linear rib 82 are disposed on the outside sidewall 66 of each wing portion 32 and extend along the length 62 of the body portion 30 in an orientation parallel to each other and parallel to the flat peripheral edges 60.

The linear channels 80 and linear ribs 82 are configured to deform in response to deformation of the wing portions 32 and permit to wing portions to flex to a greater degree than if no channels or ribs were provided. The linear channel 80 has a cross-sectional contour defining a recess 84 having an open end 86. As the linear channels 80 deform in response to deformation of the wing portion 32, the recess portion 84 of the channel expands and becomes wider permitting substantial deformation of the wing portions without tearing of the body portion.

More significantly, the linear channels 80 and linear ribs 82 are configured to grippingly and sealingly engage the surface of the window jamb 14 or the surface of the rough opening 16, respectively, to form a sealingly resilient barrier therebetween. The recess portion 84 of the linear channel 80 provides frictional gripping and creates a seal between the outside sidewall 66 of the wing portion 32, and the surface of the window jamb 14 or the surface of the rough opening 16, respectively. Accordingly, if the window structure shifts, resulting in dimensional changes in gap 12 size, the weather stripping 10 remains intact with the wing portions 32 sealed against the window jamb 14 and the rough opening 16 since the material deforms to accommodate any dimensional changes.

The linear rib 82 has a cross-sectional contour defining a projection 88 and such a contour provides tensional gripping to provide a seal between the outside sidewall 66 of the wing portion 32, and the surface of the window jamb 14 or the surface of the rough opening 16, respectively. Thus, the linear channels 80 and the linear ribs 82 are configured to form a seal between the wing portions 32 and the surfaces 14 and 16 against which they are compressed.

Figure 4A:
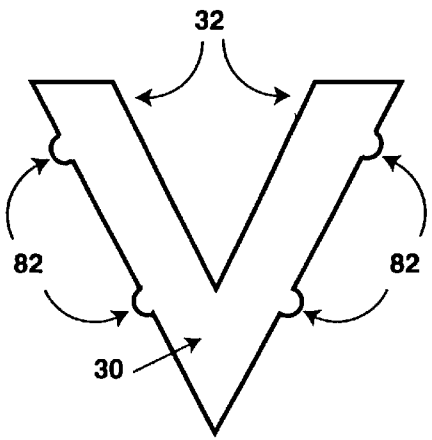
FIGS. 4A–4F are side cross-sectional views of alternate embodiments of a compressible foam weather stripping according to the present invention illustrating various rib and channel configurations.
Figure 4B:
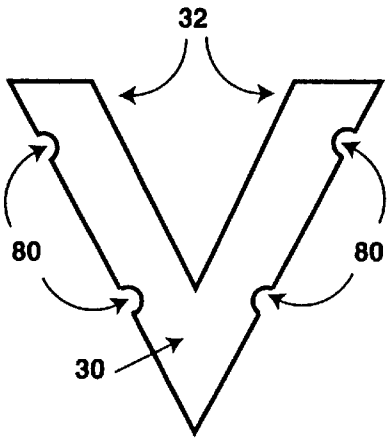
Figure 4C:
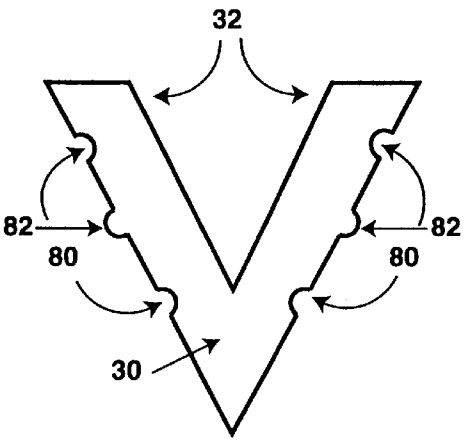
Figure 4D:
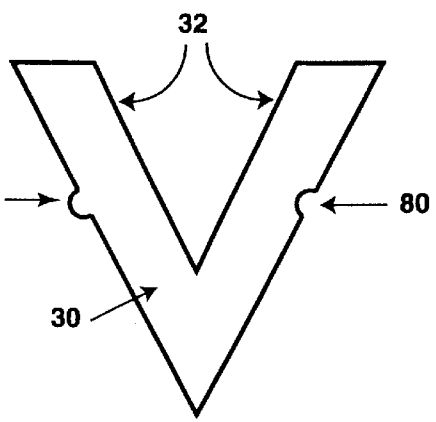
Figure 4E:
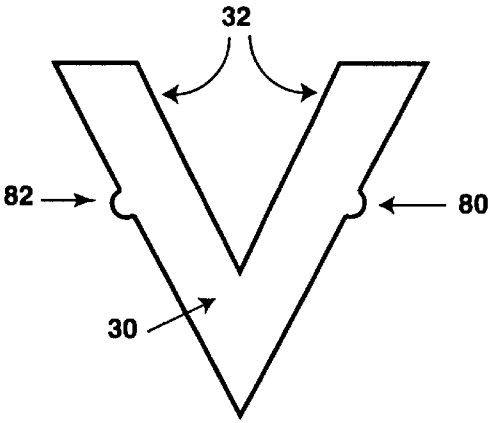
Figure 4F:
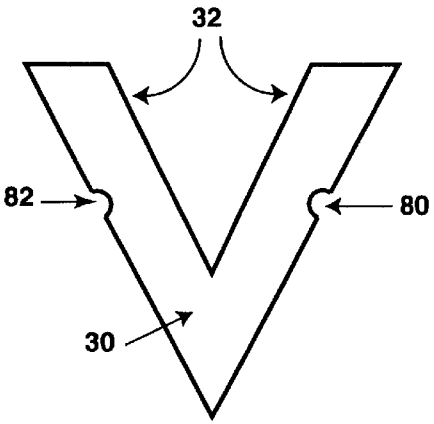

Referring now to FIGS. 4A–4F, alternate embodiments of linear channels 80 and linear ribs 82 are illustrated in various configurations. As illustrated in FIG. 4A, the wing portions 32 each include two linear ribs. As illustrated in FIG. 4B, the wing portions 32 each include two linear channels 80 and in FIG. 4C, the wing portions 32 each include one linear channel 80 and two linear ribs. FIG. 4D illustrates use of one rib 82 and one channel 80, FIG. 4E illustrates use of one rib 82 in each wing portion 32 and FIG. 4F illustrates use of one channel 80 in each wing portion. However, any suitable number of linear channels 80 and/or linear ribs 82 may be used depending upon the application.

Referring now to FIGS. 1–3, in operation, the weather stripping 10 is placed in the gap 12 with the vertex 34 pointing into the gap. The user then applies a spatula, putty knife or other suitable tool (not shown) to the interior portion of the V-shaped gap portion 61 and applies pressure thereagainst. Forward pressure of the tool causes the vertex 34 to enter gap 12 which causes the wing portions 32 to deform inwardly toward each other. As the weather stripping 10 is forced deeper into the gap 12, the wing portions 32 deform further and compress until oppositely facing inside sidewalls 64 touch. This procedure is used along the entire length of the weather stripping until all borders of the window 18 are sealed. When the weather stripping 10 has been fully inserted into the gap 12 along all edges of the window 18, the work is complete.

A specific embodiment of a compressible foam weather stripping according to the present invention has been described for the purpose of illustrating the manner in which the invention may be made and used. It should be understood that implementation of other variations and modifications of the invention and its various aspects will be apparent to those skilled in the art, and that the invention is not limited by the specific embodiments described. It is therefore contemplated to cover by the present invention any and all modifications, variations, or equivalents that fall within the true spirit and scope of the basic underlying principles disclosed and claimed herein.

What is claimed is:

1. A resilient, deformable sealing strip for sealing a space between multiple surfaces comprising:

a generally V-shaped body portion formed of a resilient and volumetrically compressible material, said body portion material having a predetermined volume in a non-compressed condition;

said body portion having two wing portions each having distal and proximal ends and continuous outside surface portions, said proximal ends meeting at a common vertex and diverging from each other at a predetermined angle, said body defining a V-shaped gap of predetermined area between said wing portions;

said body portion having a planar axis intersecting the predetermined angle defined by the vertex and the two wing portions and extending away from the vertex through the V-shaped gap toward a predetermined point between the distal ends of the wing portions;

each said wing portion further includes at least one linear channel and linear rib, said at least one linear channel and linear rib disposed on an outside surface of the wing portions and extending along a length of the body portion, wherein each of said at least one linear channel are formed as concave depressions which lie beneath an exterior plane of each said wing portion and each of said at least one linear rib are formed as convex protrusions above said exterior plane of each said wing portion; and said at least one linear channel and linear rib configured to deform in response to said deformation of the wing portions, wherein said wing portions resiliently deform inwardly toward each other, thereby decreasing the area of said V-shaped gap, in response to a compressive force acting on the outside surface portion of at least one wing portion, and resiliently deform outwardly away from each other, thereby increasing the area of said V-shaped gap, in response to a decrease in the compressive force acting on the outside surface portion of at least one wing portion; and wherein said volume of said body portion material decreases in response to a compressive force acting on the outside surface portion of at least one wing portion and increases in volume in response to a decrease in the compressive force acting on the outside surface portion of at least one wing portion.

2. The sealing strip of claim 1 wherein said at least one of a linear channel has a cross-sectional contour defining a recess having an open end.

3. The sealing strip of claim 1 wherein said at least one of a linear rib has a cross-sectional contour defining a projection.

4. The sealing strip of claim 1 wherein the wing portions are configured to deform such that wing portions meet each other along inside surfaces of the wing portions substantially coplanar with the planar axis.

5. The sealing strip of claim 1 wherein the predetermined angle is between about thirty degrees and about eighty-five degrees.

6. The sealing strip of claim 5 wherein the predetermined angle is about between fifty-five and sixty-five degrees.

7. The sealing strip of claim 1 wherein a width of the V-shaped body portion measured between the distal ends of the wing portions is between about 1.5 inches and about 3.0 inches.

8. The sealing strip of claim 1 wherein a width of the V-shaped body portion measured between the distal ends of the wing portions is between about 1.0 inch and about 5.0 inches.

9. The sealing strip of claim 1 wherein a height of the V-shaped body portion measured between the vertex and the distal ends of the wing portions is between about 1.5 inches and about 5.0 inches.

10. The sealing strip of claim 1 wherein a height of the V-shaped body portion measured between the vertex and the distal ends of the wing portions is between about 1.0 inch and about 8.0 inches.

11. The sealing strip of claim 1 wherein the body portion is formed of compressible polyurethane foam of a thermally insulating type.

12. A method of sealing a space between multiple surfaces, said method comprising:

(I) placing the vertex of the sealing strip of claim 1 into the space between said multiple surfaces;

(ii) applying a force on the sealing strip so as to cause the sealing strip to be inserted into said space, said wing portions of said sealing strip resiliently deforming inwardly toward each other and said body volumetrically compressing as said sealing strip is inserted progressively further into said space;

wherein said inserted sealing strip forms a seal along the outside surface portion of each wing portion in conjunction with said multiple surfaces defining said space, and further wherein said outside surface portions maintain sealing contact with the multiple surfaces as the space substantially varies in size within a predetermined range.

13. The method of claim 12, wherein said multiple surfaces defining said space comprise a window jamb and a rough opening of a window.

14. The method of claim 12 wherein each said wing portion further includes at least one of a linear channel and a linear rib disposed on an outside surface of the wing portions and extending along a length of the body portion, said at least one of a linear channel and a linear rib deforming in response to said deformation of the wing portions to grippingly and sealingly engage said multiple surfaces to form a sealingly resilient barrier therebetween.

15. The method of claim 14 wherein said at least one of a linear channel frictionally grips at least one of said multiple surfaces to form a seal between the outside surface of the wing portion and said at least one of said multiple surfaces, said body portion forming a compressible barrier therebetween.

16. The method of claim 14 wherein said at least one of a linear rib tensionaly grips at least one of said multiple surfaces to form a seal between the outside surface of the wing portion and said at least one of said multiple surfaces, said body portion forming a compressible barrier therebetween.

17. The method of claim 15 wherein said at least one of a linear channel has a cross-sectional contour defining a recess having an open end, said recess frictionally gripping and sealingly engaging at least one of said multiple surfaces.

18. The method of claim 15 wherein said at least one of a linear rib has a cross-sectional contour defining a projection, said projection tensionally gripping and sealingly engaging at least one of said multiple surfaces.

* * * * *